US011873610B2

(12) United States Patent
Herrera

(10) Patent No.: US 11,873,610 B2
(45) Date of Patent: Jan. 16, 2024

(54) BOLLARD SYSTEM

(71) Applicant: 8-Koi, Inc., Merritt Island, FL (US)

(72) Inventor: Otto Edward Herrera, Orange Park, FL (US)

(73) Assignee: 8-Koi, Inc., Merritt Island, FL (US)

( * ) Notice: Subject to any disclaimer, the term of this patent is extended or adjusted under 35 U.S.C. 154(b) by 0 days.

(21) Appl. No.: 17/710,285

(22) Filed: Mar. 31, 2022

(65) Prior Publication Data

US 2022/0220680 A1 Jul. 14, 2022

Related U.S. Application Data

(63) Continuation of application No. 16/947,544, filed on Aug. 6, 2020, now Pat. No. 11,319,681.

(51) Int. Cl.

| | |
|---|---|
| ***E01F 9/646*** | (2016.01) |
| ***E01F 9/654*** | (2016.01) |
| ***E01F 9/70*** | (2016.01) |
| ***E01F 15/00*** | (2006.01) |

(52) U.S. Cl.

CPC ..... *E01F 9/646* (2016.02); *E01F 9/654* (2016.02); *E01F 9/70* (2016.02); *E01F 15/003* (2013.01)

(58) Field of Classification Search

CPC . E01F 9/623; E01F 9/646; E01F 9/654; E01F 9/70; E01F 13/08; E01F 13/123; E01F 15/003

See application file for complete search history.

(56) References Cited

U.S. PATENT DOCUMENTS

| | | | | |
|---|---|---|---|---|
| 2,941,185 A * | 6/1960 | Mullikin | G08G 1/0955 | 116/63 P |
| 3,734,595 A * | 5/1973 | Bendzick | B60Q 7/005 | 116/63 P |
| 4,762,439 A * | 8/1988 | Carlyle | E01F 13/085 | 404/11 |
| 5,146,710 A * | 9/1992 | Caldwell | E01F 13/08 | 49/132 |
| 5,970,639 A * | 10/1999 | Hui | B60Q 7/00 | 40/610 |

(Continued)

FOREIGN PATENT DOCUMENTS

| | | | |
|---|---|---|---|
| CN | 110080133 A * | 8/2019 | E01F 13/04 |
| GB | 2348228 A * | 9/2000 | E01F 13/08 |

*Primary Examiner* — Gary S Hartmann

(74) *Attorney, Agent, or Firm* — Mark Malek; Jonathan Staudt; Widerman Malek, PL

(57) ABSTRACT

A bollard system may includes a bollard, a carrier device, a lock plate, and a cover plate. The bollard may be rotatable between a deployed configuration and a stowed configuration. The carrier device may have a recess adapted to carry the bollard in the stowed configuration, and may be adapted to be recessed within the ground. The lock plate may be adapted to maintain the bollard in the deployed configuration. The cover plate may be carried by the carrier device and adapted to cover a portion of the recess. The cover plate may be moveable between an opened position and a closed position. When the cover plate is in the opened position, the bollard may be rotatable between the deployed configuration and the stowed configuration. When the cover plate is in the closed position, the cover plate may be configured to be flush with the ground.

20 Claims, 6 Drawing Sheets

(56) References Cited

U.S. PATENT DOCUMENTS

| | | | | |
|---|---|---|---|---|
| 8,439,594 | B1 * | 5/2013 | Clark | E01F 13/123 404/9 |
| 9,228,304 | B2 * | 1/2016 | Brackin | E01F 13/12 |
| 9,919,236 | B1 * | 3/2018 | Gross | A63K 3/02 |
| 11,319,681 | B2 * | 5/2022 | Herrera | E01F 9/646 |
| 2019/0257045 | A1 * | 8/2019 | Bock, II et al. | E01F 13/123 |

* cited by examiner

BOLLARD SYSTEM

RELATED APPLICATIONS

This application is a continuation application of and claims priority under 35 U.S.C. § 120 of U.S. patent application Ser. No. 16/947,544 filed on Aug. 6, 2020 and titled BOLLARD SYSTEM. The content of this application is incorporated herein by reference.

FIELD OF THE INVENTION

The present invention relates to systems for bollards. More specifically, the present invention relates to a system for easily deployable and storable bollards.

BACKGROUND OF THE INVENTION

Bollards are short vertical posts that are often used to obstruct the passage of motor vehicles. In conventional systems, each bollard is attached to a horizontal steel beam that is embedded in concrete. In embodiments wherein bollards are not permanently desired, beach bollard may be removed from its steel beam and stored when not in use. This creates a significant man-power and logistics concern to remove and install the bollards when necessary as the bollards must be stored remotely from where they will be deployed. Therefore, a need exists for a bollard system, which allows the bollard to be stored in place and easily deployed.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

The present invention addresses the deficiencies in the prior art by providing a bollard system that is easily storable, installable, and deployable. The bollard system may have a bollard, a carrier device, a lock plate, and a cover plate. The bollard may be rotatable between a deployed configuration and a stowed configuration. The carrier device may have a recess adapted to carry the bollard in the stowed configuration, and the carrier device may be adapted to be recessed within the surface of the ground. The lock plate may be adapted to be received by the carrier device to maintain the bollard in the deployed configuration.

The cover plate may be carried by the carrier device and may be adapted to cover at least a portion of the recess of the carrier device. The cover plate may be moveable between an opened position and a closed position. When the cover plate is in the opened position, the bollard may be rotatable between the deployed configuration and the stowed configuration. When the cover plate is in the closed position, the cover plate may be configured to be flush with the surface of the ground.

The cover plate may include a first cover plate and a second cover plate. The first and second cover plates may be hingedly connected to the carrier device and may be moveable between the open position and the closed position.

The system may include at least one protrusion extending outwardly from a first end of the carrier device. The protrusion(s) may be adapted to contact an object with a torsional force when the object contacts the bollard in the deployed configuration with a predetermined force that may be defined as a force that moves the protrusion from its installed position.

The system may further include a front retaining plate that may be secured to the carrier device proximate the bollard on a side of the bollard that opposes the recess. The front retaining plate may be configured to prevent rotation of the bollard beyond an angle measured between the bollard and the carrier device in the deployed configuration.

The system may yet further include a pivot rod that may be secured to the bollard and received by a pivot carrier of the carrier device. The bollard may rotate between the deployed configuration and the stowed configuration about a longitudinal axis of the pivot rod. The front retaining plate may be positioned and configured to retain the pivot rod within the recess when secured to the carrier device and may allow removal of the pivot rod from the recess when unsecured from the carrier device.

The lock plate may be configured to prevent the bollard from moving from the deployed position when the bollard is impacted.

The carrier device may include a first lock plate channel formed in a wall on a side of the recess and a second lock plate channel formed in a wall on a side that is opposite of the first side. The first lock plate channel and the second lock plate channel may be cooperatively configured to carry the lock plate when the bollard is in the deployed configuration.

The system may include a tether that has one end secured to the carrier device and another end secured to the lock plate. The carrier device may include a plurality of planar members carried by the carrier device and that may be adapted to support a combined weight of the bollard and an object placed upon the cover plate when in the stowed configuration. Each of the plurality of planar members may have an arcuate surface.

Another embodiment may be a bollard system having a bollard, a carrier device, a lock plate, a cover plate, a pivot rod, at least one protrusion, and a front retaining plate. The bollard may be rotatable between a deployed configuration and a stowed configuration. The carrier device may have a recess adapted to carry the bollard in a stowed configuration, and the carrier device may be adapted to be recessed within the ground.

The lock plate may be adapted to be received by the carrier device to maintain the bollard in the deployed configuration. The cover plate may be carried by the carrier device and may be adapted to cover at least a portion of the recess of the carrier device. The cover plate may be moveable between an opened position and a closed position.

The pivot rod may be secured to the bollard and received by a pivot carrier of the carrier device. The protrusion(s) may extend outwardly from an end of the carrier device. The front retaining plate may be secured to the carrier device proximate the bollard on a side of the bollard opposing the recess. When the cover plate is in the opened position, the bollard may be rotatable between the deployed configuration and the stowed configuration. When the cover plate is in the closed position, the cover plate may be flush with the surface of the ground.

The front retaining plate may be configured to prevent rotation of the bollard beyond a deployed angle measured between the bollard and the carrier device in the deployed configuration. The protrusion(s) may be adapted to contact an object with a torsional force when the object contacts the bollard in the deployed configuration with a predetermined force defined as a force that moves the protrusion from its installed position.

The bollard may rotate between the deployed configuration and the stowed configuration about a longitudinal axis of the pivot rod. The front retaining plate may be positioned and configured to retain the pivot rod within the recess when secured to the carrier device and may allow removal of the pivot rod from the recess when unsecured from the carrier device.

Another embodiment may be a bollard system having a bollard, a carrier device, a lock plate, a cover plate, a front retaining plate, and a pivot rod. The bollard may be rotatable, and the carrier device may have a recess adapted to carry the bollard. The lock plate may be adapted to be received by the carrier device, and the cover plate may be carried by the carrier device and may be adapted to cover at least a portion of the recess of the carrier device.

The front retaining plate may be secured to the carrier device proximate the bollard on a side of the bollard opposing the recess. The pivot rod may be secured to the bollard and may be received by a pivot carrier of the carrier device. The front retaining plate may be configured to prevent rotation of the bollard beyond a deployed angle measured between the bollard and the carrier device.

The carrier device may include a first lock plate channel formed in a wall on a side of the recess and a second lock plate channel formed in a wall on another side that may oppose the first side. The first lock plate channel and the second lock plate channel may cooperatively be configured to carry the lock plate.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
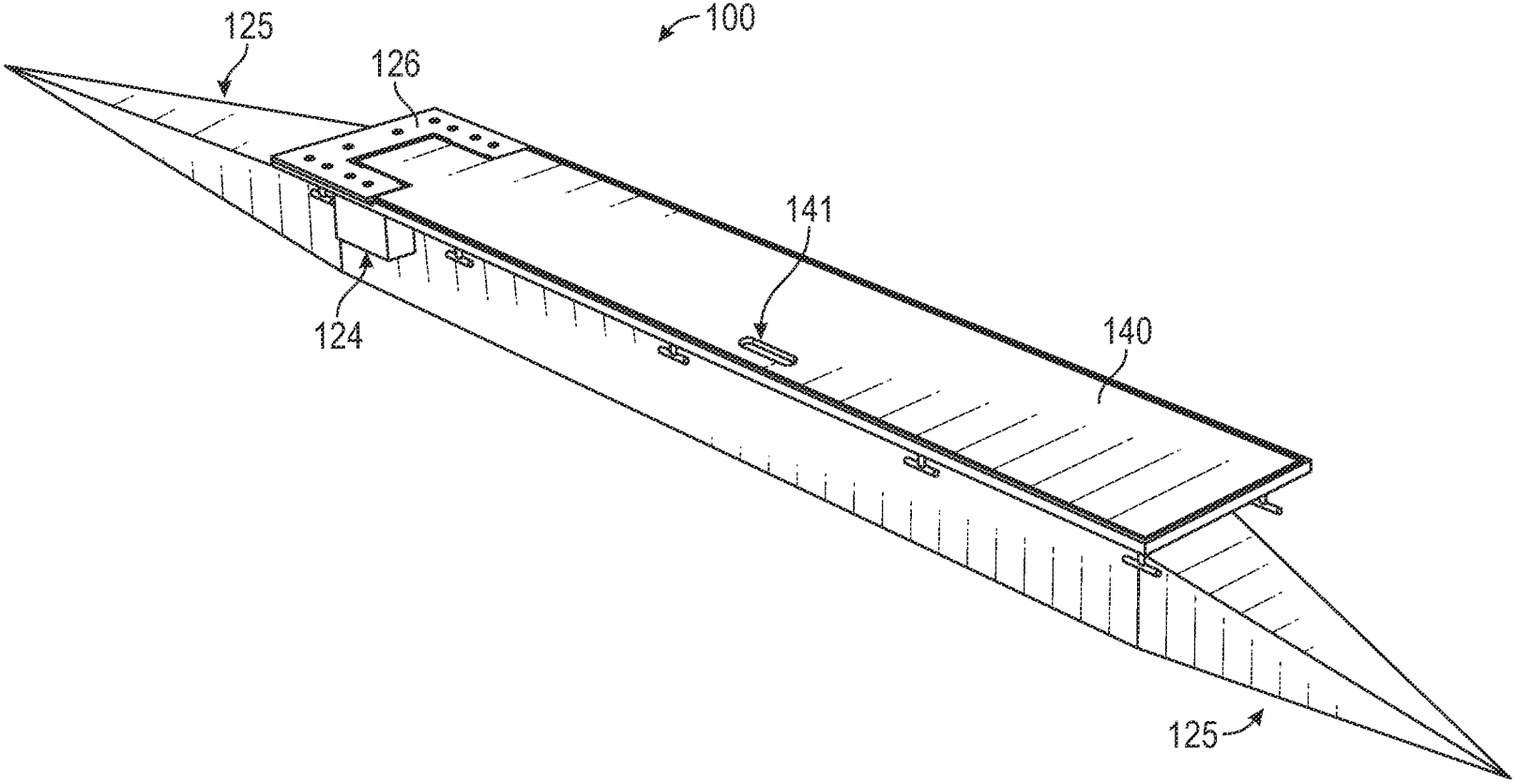
FIG. 1 is a perspective view of a bollard system according to an embodiment of the present invention in the stowed configuration.
Figure 2:
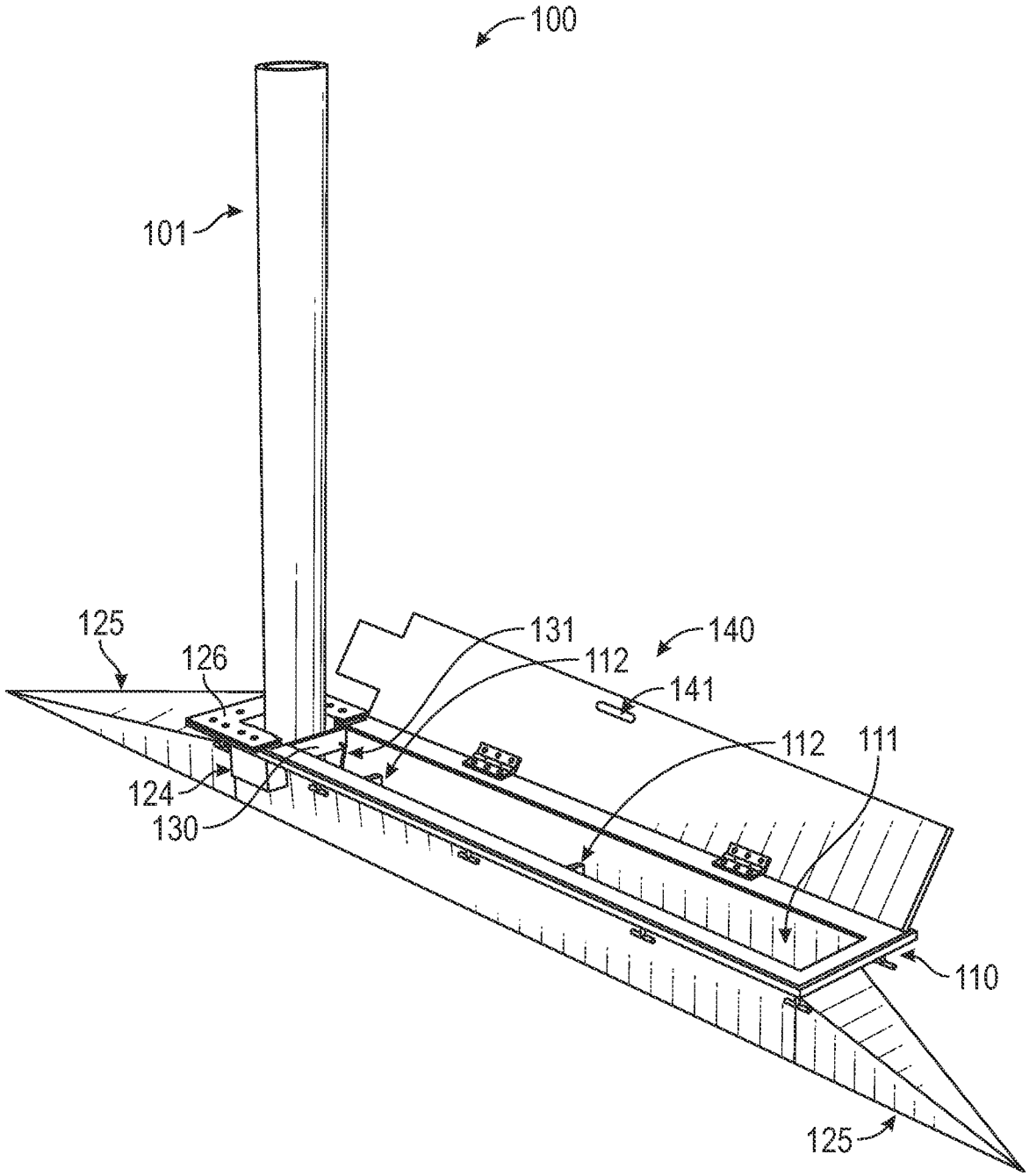
FIG. 2 is a perspective view of the bollard system of FIG. 1 in the deployed configuration.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a bollard system 100, which may include a bollard 101, a carrier device 110, a pivot rod 120, a lock plate 130, and a cover plate 140.

Figure 3:
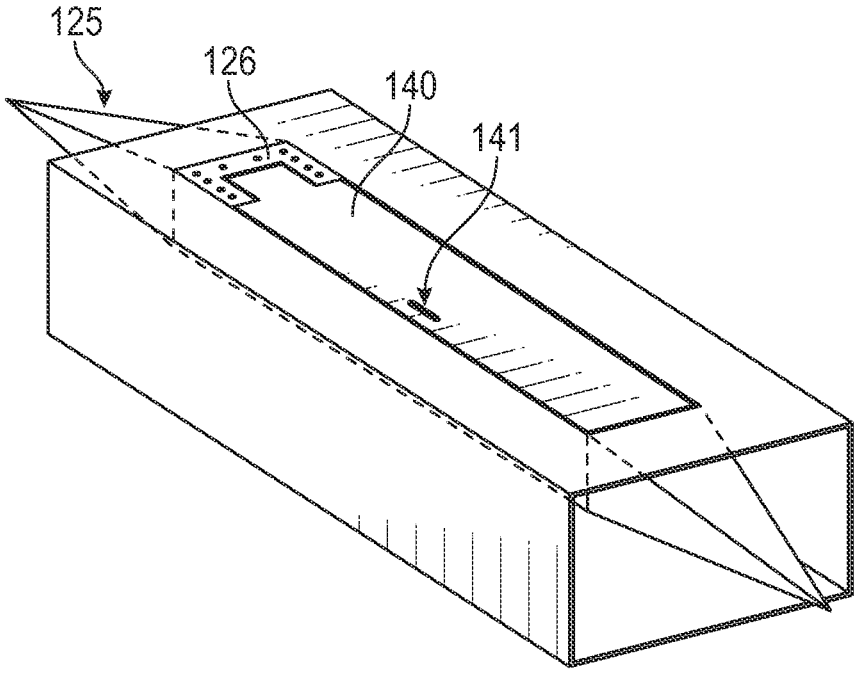
FIG. 3 is an environmental view of the bollard system of FIG. 1.
Figure 4:
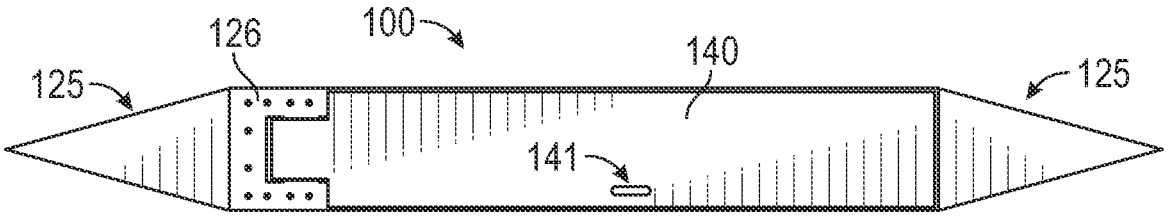
FIG. 4 is a top plan view of the bollard system of FIG. 1.
Figure 5:
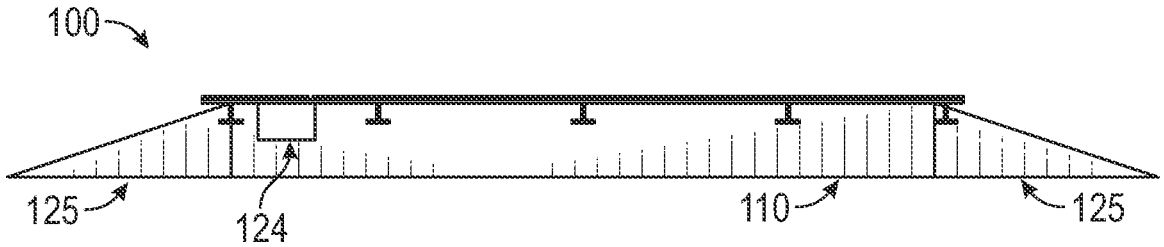
FIG. 5 is a side elevation view of the bollard system of FIG. 1.
Figure 6:
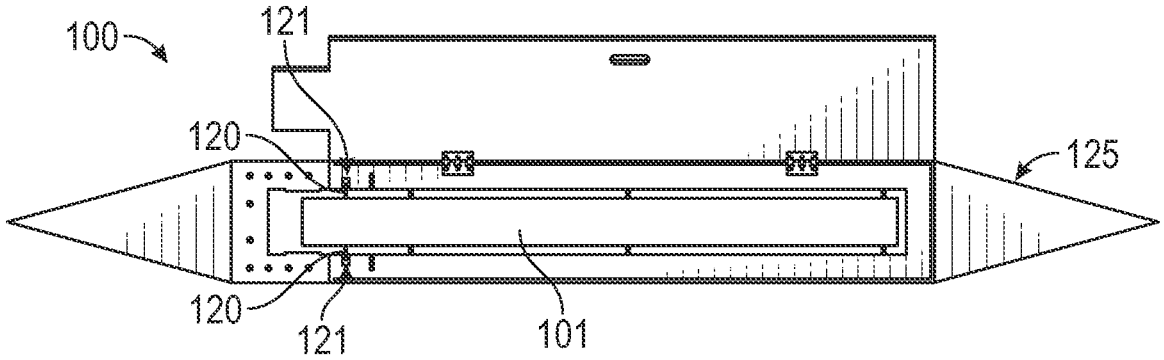
FIG. 6 is a top plan view of the bollard system of FIG. 1.
Figure 7:
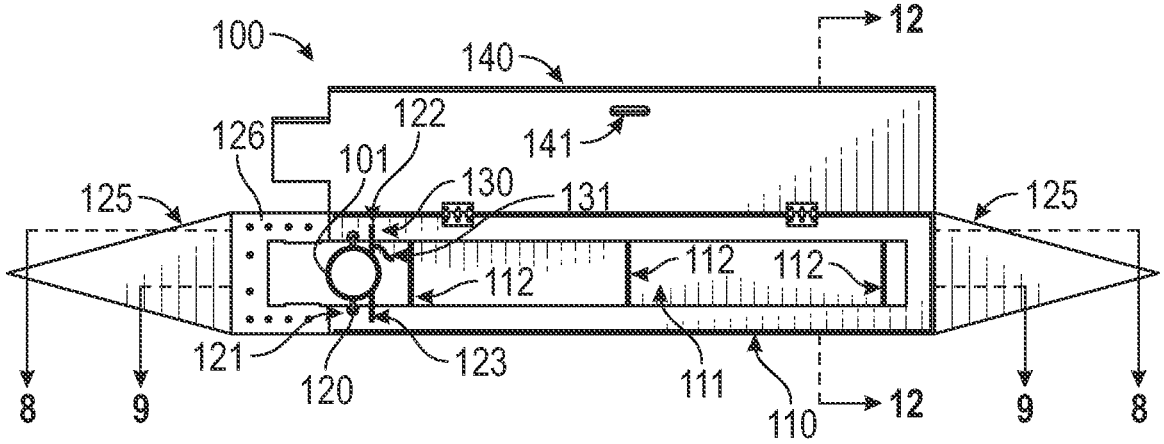
FIG. 7 is a top plan view of the bollard system of FIG. 1 in the deployed configuration.
Figure 8:
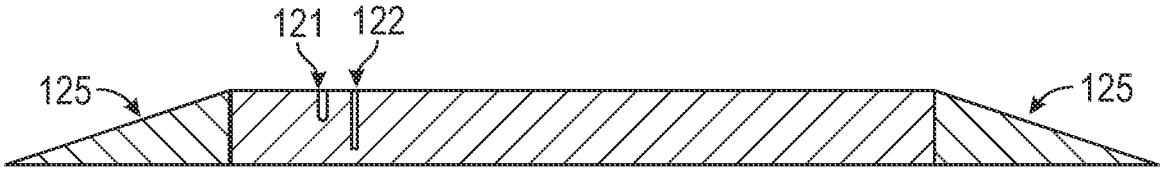
FIG. 8 is a cross-section view of the bollard system taken through line 8-8 in FIG. 7.
Figure 9:
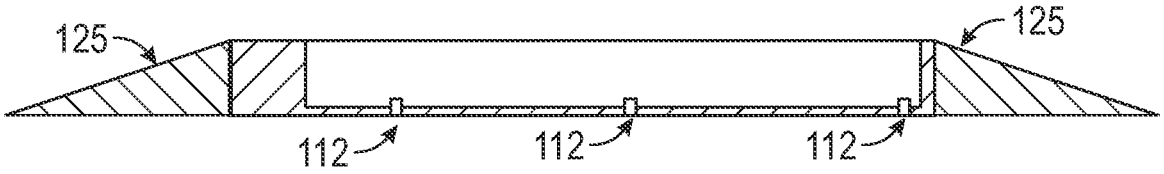
FIG. 9 is a cross-section view of the bollard system taken through line 9-9 in FIG. 7.

When installed, the bollard system 100 may be recessed into a ground surface, as depicted at least in FIG. 3. The top of the cover plate 140 may be flush with the ground surface when in the closed configuration. The side walls of the carrier device 110, protective box 124, and protrusion 125 may be underground. In the deployed configuration, the bollard 101 may extend above the ground surface while, in the stowed configuration, the bollard 101 may be carried within the recess 111 below ground level. When in the deployed configuration, a vehicle or other object may move into a position in contact with the bollard 101. The bollard 101 may be designed and configured to prevent the vehicle or other object from moving past the bollard 101 when in the deployed configuration.

The carrier device 110 may be an elongate structure having a recess 111 formed in an interior portion. The recess 111 may be sized and constructed to carry the bollard 101 when in the stowed configuration. The carrier device 110 may have a pivot carrier 121 located proximate a first end of the recess 111. The pivot carrier 121 may be a notch or a groove formed in a side wall defining the recess 111 of the carrier device 110. There may be a pair of notches or grooves formed on opposing sides of the recess 111 of the carrier device 110 to form the pivot carrier 121.

A pivot rod 120 may be secured proximate a first end of the bollard 101. The pivot rod 120 may be an elongate structure, it may be hollow or solid, and it may be cylindrical. A single pivot rod 120 may extend through an entirety of a thickness of the bollard 101 near the first end. Alternatively, a first pivot rod 120 may be secured to a first side of the bollard 101 with a second pivot rod 120 secured to a second, opposing side of the bollard 101. In either embodiment, the pivot rod 120 is fixedly secured to the bollard 101 with portions of the pivot rod 120 extending from the perimeter of the bollard 101 at opposing sides of the bollard, with a projected line between each longitudinal axis of the protruding pivot rods 120 extending through a center of a cross-section of the bollard 101. The pivot rod 120 may be received by the pivot carrier 121. Each end of a single pivot rod 120 or, in embodiments with two separate pivot rods 120, one end of each of the pivot rods 120 may be received by the pivot carrier 121.

The bollard 101 may be adapted to rotate about a longitudinal axis of the pivot rod 120, which may be perpendicular to a longitudinal axis of the bollard 101. In a stowed configuration, the bollard 101 may be positioned within the recess 111 of the carrier device 110 and the carrier device 110 may support some or all of the weight of the bollard 101 along a length of the carrier device 110. In the deployed configuration, the bollard 101 may be rotated approximately 90 degrees about the pivot carrier 121 to be positioned orthogonally to the length of the carrier device 110. In such an embodiment, the weight of the bollard 101 may be supported by a portion of the carrier device 110 directly beneath the end of the bollard 101 in which the pivot rod 120 is carried.

The carrier device 110 may receive a lock plate 130 adapted to maintain the bollard 101 in the deployed configuration. The lock plate 130 may be a rigid, planar structure adapted to prevent rotation of the bollard 101 about the pivot rod 120 into the stowed configuration when the bollard 101 is in the deployed configuration.

In one embodiment, the carrier device may include a pair of lock plate channels 122, 123 adapted to receive a lock plate 130. The first lock plate channel 122 may be positioned on a side wall of the carrier device 110, which defines a first side of the recess 111. The second lock plate channel 123 may be positioned on a side wall of the carrier device 110, directly opposing the first lock plate channel 122, on a second side of the recess 111. The first and second lock plate channels 122, 123 may be positioned in a side wall of the carrier device 110 a distance from the pivot carrier 121 equal to a radius of the bollard 101. This placement of the lock plate channels 122, 123 allows a lock plate 130 to be positioned within the channels 122, 123 and extend across an entirety of the width of the recess 111 without interference from the bollard 101. The lock plate 130 may be secured to the carrier device 110 with a flexible tether 131. The tether 131 may have a first end secured to the lock plate 130 and a second end secured to the carrier device 110. The tether may be adapted to allow the lock plate 130 to be positioned in and carried by the first lock plate channel 122 and the second lock plate channel 123 when the bollard is in the deployed configuration and to be removed from the channels 122, 123 and carried in the bottom of the recess 111, below the bollard 101, when the bollard 101 is in the stowed configuration.

Figure 13:
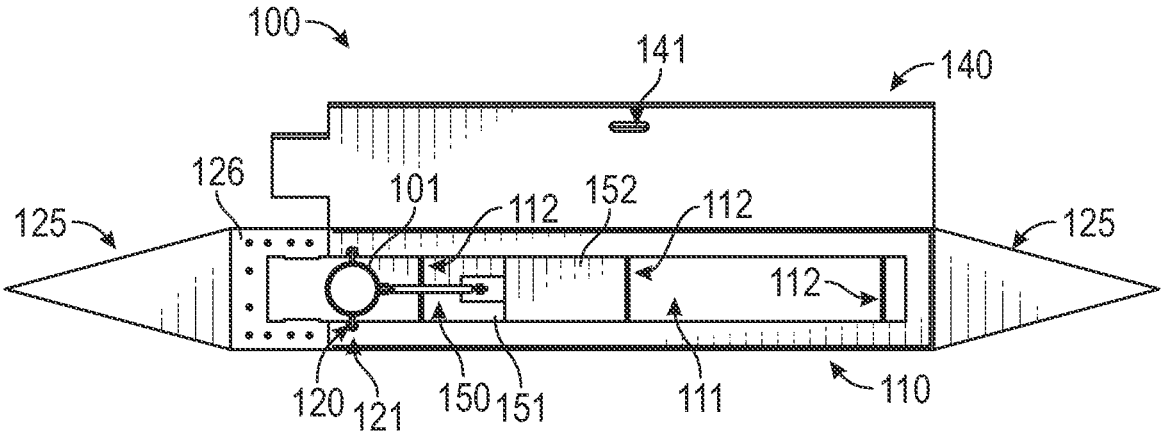
FIG. 13 is a top plan view of an embodiment of the bollard system in the deployed configuration.

In another embodiment, as depicted at least in FIG. 13, the lock plate 130 may hingedly secure to a rigid support 150 at a first end of the rigid support 150. The rigid support 150 may have a second end hingedly secured to the bollard 101. The rigid support 150 may be an elongate member and may be solid or hollow. In one embodiment, the rigid support 150 may be a tube. In embodiments in which the lock plate 130 is secured to a rigid support 150, the rigid support 150 may support the weight of the bollard 101 and, along with the lock plate 130, may prevent the bollard from moving out of the deployed configuration. In an engaged position, the lock plate 130 may be positioned close enough to the bollard 101 to position the rigid support 150 at an acute angle with respect to the portion of the bollard 101 below the rigid support 150. Such a positioning of the rigid support 150 may maintain the bollard 101 in the deployed configuration.

The lock plate 130 may be positioned on an elongate surface 152 of the carrier device 110. The elongate surface 152 may be formed on the interior surface of the bottom of the carrier device 110, may be formed along a side of the carrier device 110, or may be located within an interior of the carrier device 110. In the disengaged position, the lock plate 130 may freely move along the elongate surface 152 in a direction parallel to a longitudinal axis of the carrier device 110. A lock plate recess 151 may be formed in the elongate surface 152. The surface of the lock plate recess 151 may be in a plane parallel to and below the plane of the elongate surface 152. As the bollard 101 rotates from the stowed configuration to the deployed configuration, the end of the rigid support 150 secured to the lock plate 130 and may move along the elongate surface 152 toward the lock plate recess 151. When the bollard 101 reaches the deployed configuration, an entirety of the lock plate 130 may be positioned within the lock plate recess 151 in the engaged position. In the engaged position, the lip defining the transition between elongate surface 152 and lock plate recess 151 may be in contact with one end of the lock plate 130 and prevent the lock plate 130 from moving out of the lock plate recess 151. An upward force may be applied to the lock plate 130 to move it out of the engaged position and back to the disengaged position, in which the lock plate 130 may move along the elongate surface 152 away from the bollard 101 to position the bollard 101 in the stowed configuration.

A protective box 124 may be secured to the carrier device 110. In one embodiment, the protective box 124 may be located on both sides of the carrier device 110 outward of the recess 111. The protective box 124 may be secured to an outer surface of the carrier device 110. The protective box 124 may be secured to the carrier device 110 to define a void therebetween. In one embodiment, a structure may be secured to each side of the carrier device 110, opposing one another and creating two separate voids. Either one of these structures, or the combination of both of these structures may be referred to as the protective box 124. The protective box 124 may be placed on the outer surface of the carrier device 110 and surround the pivot carrier 121, the first lock plate channel 122, and the second lock plate channel 123. The top side of the pivot carrier 121, first lock plate channel 122, and second lock plate channel 123 may be left uncovered to allow the lock plate 130 and the pivot rod 120 to enter and be removed from these devices from the top of the bollard system 100. The protective box 124 may extend outwardly from the carrier device 110.

Figure 12:
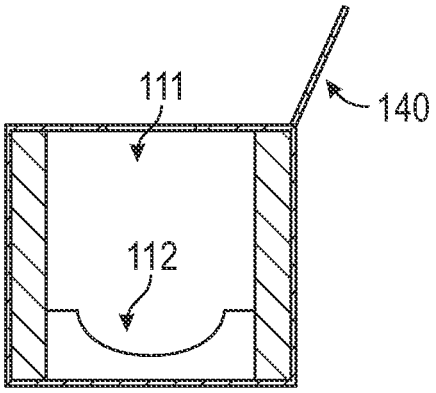
FIG. 12 is a cross-section view of the bollard system taken through line 12-12 in FIG. 7.

A plurality of planar members 112 may be secured to a bottom interior wall defining the recess 111 of the carrier device 110. The plurality of planar members 112 may be adapted to support the bollard 101 when in the stowed configuration. As shown at least in FIG. 12, each of the plurality of planar members 112 may have an arcuate surface opposing the side secured to the bottom of the recess 111 of the carrier device 110. The curvature of the arcuate surface may reciprocate the curvature of the bollard 101. Each of the plurality of planar member 112 may be adapted to receive and carry the weight of the bollard 101 in the stowed configuration. Additionally, when in the stowed configuration, vehicles or other items may drive or pass over the bollard system 100. The weight of these vehicles or other items must be supported by the bollard system 100 when positioned over the bollard system 100. The plurality of planar members 112 may be adapted to support the weight exerted by such a vehicle or other item in addition to the weight of the bollard 101 itself.

A protrusion 125 may be secured to one or more ends of the carrier device 110. The protrusion 125 may be an elongate, rigid member. In one embodiment, the protrusion 125 may be sharp or pointed at the end distal the connection to the carrier device 110. The protrusion 125 may extend away from the carrier device 110 along a longitudinal axis thereof. The protrusion 125 may be configured to angle upward from its underground installed position when a vehicle or object applies torsional force to the bollard 101 in the deployed position. The protrusion 125 may be adapted to strike, and potentially disable, a vehicle applying torsional force to the bollard 101 in the deployed configuration.

A cover plate 140 may be received by the carrier device 110 and adapted to cover the bollard 101 and the recess 111 when the bollard 101 is in the stowed configuration. The cover plated 140 may rest on a ridge formed about the perimeter of the recess 111. The cover plated 140 may be hingedly secured to the carrier device 111 and selectively positioned in an open configuration or a closed configuration. In the closed configuration, the cover plate 140 may cover the recess and prevent pedestrians from accidentally falling into the recess 111 when the bollard 101 is in the deployed configuration. In the closed configuration, the cover plate 140 may also cover the recess 111 and the bollard 101 and protect these components when the bollard 101 is in the stowed configuration. The cover plate 140 may be at the level of surrounding ground when in the closed configuration. The cover plate 140 may be moved into an open configuration, in which the recess 111 is exposed, to allow the bollard 101 to transition between the stowed configuration and the deployed configuration. The cover plate 140 may cover the recess 111 or portion of the recess 111 behind the bollard 101 in the deployed configuration and occupied by the bollard 101 in the stowed configuration.

A front retaining plate 126 may cover the recess 111 or portion of the recess 111 not covered by the cover plate 140. The front retaining plate 126 may be positioned in front of the bollard 101 in the deployed configuration and above a portion of the bollard 101 in the stowed configuration. The front retaining plate 126 may cover the pivot carrier 121 when secured to the carrier device 110, thereby preventing the bollard from being removed from the carrier device 110 without removal of the front retaining plate 126. The front retaining plate 126 may not cover the first lock plate channel 122 and second lock plate channel 123 when secured to the carrier device 110, thereby allowing the lock plate 130 to be freely placed in and removed from these channels 122, 123 while the front retaining plate 126 is secured to the carrier device 110. The front retaining plate 126 may be removably secured to a frame of the carrier device 110. The front retaining plate 126 may be adapted to support the bollard 101 and prevent the bollard 101 from rotating past the deployed configuration. The front retaining plate 126 may prevent rotation of the bollard 101 in a first direction, while the lock plate 130 may prevent rotation of the bollard 101 in a second, opposite direction when the bollard is in the deployed configuration and the lock plate 130 is in an engaged position.

The front retaining plate 126 and the lock plate 130 may be configured to withstand forces of different magnitudes. By way of example, and not as a limitation, the bollard system 100 may be installed in a road way leading to a secure location. In such an embodiment, it may be desirable for the bollard system 100 to robustly prevent traffic from heading toward the secure location while providing less robust protection against vehicles heading away from the secure location. In such an embodiment, the bollard system 100 may be installed with its length parallel to the direction of traffic flow on the roadway. The lock plate 130 may be positioned on the side of the bollard 101 closer to the secure location and the front retaining plate 126 may be positioned distal the secure location. The front retaining plate 126 and the lock plate 130 may be designed to withstand different degrees of force, the effect of which may be that the lock plate 130 supports the bollard 101 in the deployed configuration when the bollard 101 is impacted by a heavy vehicle moving quickly, while the front retaining plate 126 may allow the bollard 101 to collapse into the stowed configuration when the bollard 101 is hit by a light weight vehicle moving slowly. This above is given for exemplary purposes only and one skilled in the art will readily appreciate that the lock plate 130 and front retaining plate 126 may be engineered with differing strength attributes and either one may be engineered to provide more robust support than the other.

In the example provided above, it may be desirable to position a protrusion 125 on an end of the carrier device 110 distal the lock plate 130. In such an embodiment, when the bollard 101 is impacted on the side distal the lock plate 130, the torsional force place on the bollard 101 by the impact may rotate the protrusion 125 upward from its installed position below the ground and cause it to impact the underside of the vehicle impacting the bollard 101. This may disable or damage the vehicle impacting the bollard 101 and provide secondary protection for the secure location. One skilled in the art will realize that the protrusion 125 may be placed on either or both ends of the carrier device 110 to provide protection from impact in a desired direction.

When in the deployed configuration, the bollard 101 may form approximately a 90 degree and with the carrier device 110. The angle between the bollard 101 and the carrier device 110 when in the deployed configuration may be the deployed angle.

The front retaining plate 126 may secure to the carrier device 110 over the pivot carrier 121. In such an embodiment, the front retaining plate 126 may cover the pivot rod 120 and prevent the bollard 101 from being lifted out of the carrier device 110 without removal of the front retaining plate 126. The front retaining plate 126 may be secured with a plurality of screws, bolts, or the like. Removal of the front retaining plate 126 may unsecure the pivot rod 120 and allow the bollard 101 to be lifted out of the carrier device 110 for maintenance, repair, or replacement.

Figure 10:
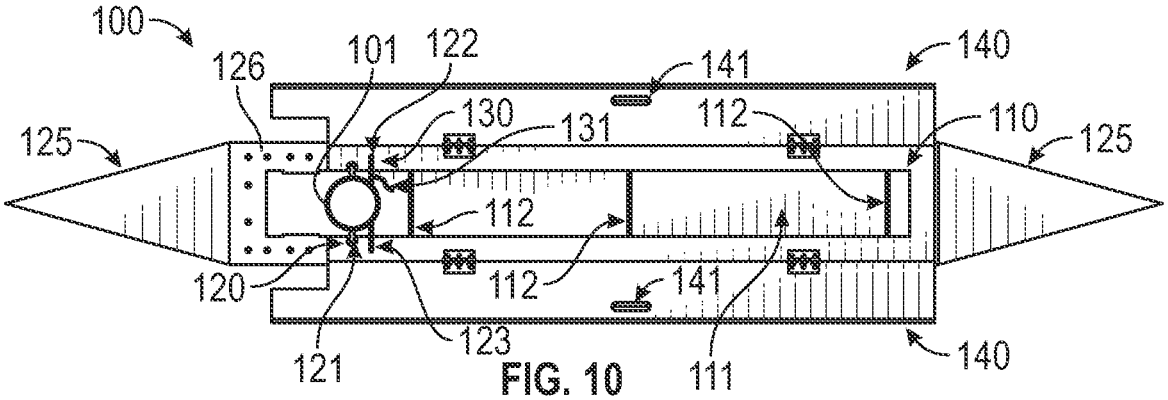
FIG. 10 is a top plan view of an embodiment of the bollard system in the deployed configuration.
Figure 11:
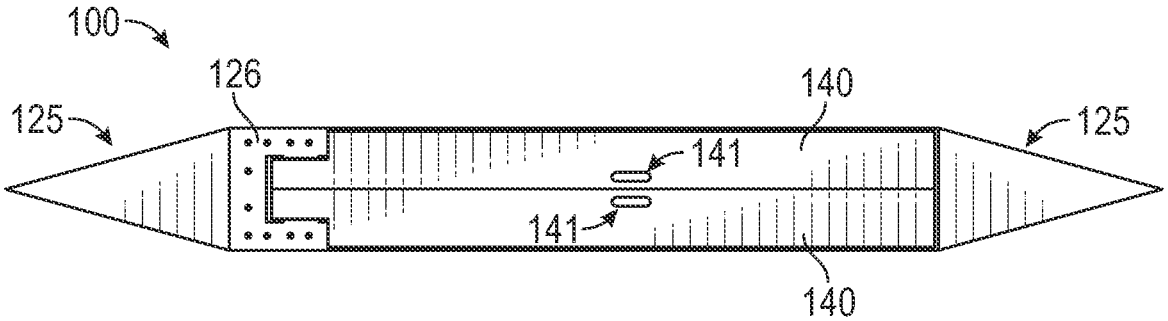
FIG. 11 is a top plan view of the bollard system of FIG. 10 in the stowed configuration.

In one embodiment, as shown at least in FIGS. 1-7, there may be one cover plate 140 hingedly secured to the carrier device 110 along a length of the carrier device 110. In another embodiment, as shown at least in FIGS. 10 and 11, there may be two cover plates 140, wherein each of the cover plates 140 are secured to the carrier device 110 along a length of the carrier device 110. One benefit of such a double cover plate 140 configuration may be a reduction in the weight of the cover plate, which may make transitioning between the open and closed configuration easier. In both embodiments, the length of the cover plate 140 may be parallel to the length of the bollard 101 and carrier device 110. The cover plate 140 may have a handle 141 located therein. The handle 141 may be grasped to transition the cover plate 140 between the open and closed configurations.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

The claims in the instant application are different than those of the parent application or other related applications. Applicant therefore rescinds any disclaimer of claim scope made in the parent application or any predecessor application in relation to the instant application. Any such previous disclaimer and the cited references that it was made to avoid, may need to be revisited. Further, any disclaimer made in the instant application should not be read into or against the parent application.

What is claimed is:

1. A bollard system comprising:

a bollard rotatable between a deployed configuration and a stowed configuration;

a carrier device having a recess adapted to carry the bollard in a stowed configuration, the carrier device being adapted to be recessed within a ground surface;

a lock plate adapted to be received by the carrier device to maintain the bollard in the deployed configuration;

a cover plate carried by the carrier device and adapted to cover at least a portion of the recess of the carrier device, the cover plate being moveable between an opened position and a closed position;

a pivot rod secured to the bollard and received by a pivot carrier of the carrier device; and a front retaining plate secured to the carrier device proximate the bollard on a side of the bollard opposing the recess;

wherein the front retaining plate is positioned and configured to retain the pivot rod within the recess when secured to the carrier device and allow removal of the pivot rod from the recess when unsecured from the carrier device;

wherein when the cover plate is in the opened position, the bollard is rotatable between the deployed configuration and the stowed configuration; and wherein when the cover plate is in the closed position, the cover plate is configured to be flush with the ground surface.

2. The bollard system of claim 1 wherein the cover plate comprises a first cover plate and a second cover plate; wherein each of the first and second cover plates are hingedly connected to the carrier device and moveable between the open position and the closed position.

3. The bollard system of claim 1 further comprising at least one protrusion extending outwardly from a first end of the carrier device; and wherein the at least one protrusion is adapted to contact an object with a torsional force when the object contacts the bollard in the deployed configuration with a predetermined force defined as a force that moves the protrusion relative to the ground surface.

4. The bollard system of claim 1 wherein the front retaining plate is configured to prevent rotation of the bollard beyond a deployed angle measured between the bollard and the carrier device in the deployed configuration.

5. The bollard system of claim 4 wherein the bollard rotates between the deployed configuration and the stowed configuration about a longitudinal axis of the pivot rod.

6. The bollard system of claim 5 wherein the lock plate is configured to prevent the bollard from moving from the deployed position when the bollard is impacted by a predetermined force from a first direction.

7. The bollard system of claim 1 wherein the carrier device has a first lock plate channel formed in a first wall on a first side of the recess and a second lock plate channel formed in a second wall on a second side, opposing the first side, of the recess; and wherein the first lock plate channel and the second lock plate channel are cooperatively configured to carry the lock plate when the bollard is in the deployed configuration.

8. The bollard system of claim 1 further comprising a tether having a first end secured to the carrier device and a second end secured to the lock plate.

9. The bollard system of claim 1 wherein the carrier device further comprises a plurality of planar members carried by the carrier device and adapted to support a combined weight of the bollard and an object placed upon the cover plate when in the stowed configuration; and wherein each of the plurality of planar members has an arcuate surface.

10. A bollard system comprising:

a bollard rotatable between a deployed configuration and a stowed configuration;

a carrier device having a recess adapted to carry the bollard in a stowed configuration, the carrier device being adapted to be recessed within a ground surface;

a lock plate adapted to be received by the carrier device to maintain the bollard in the deployed configuration;

a cover plate carried by the carrier device and adapted to cover at least a portion of the recess of the carrier device, the cover plate being moveable between an opened position and a closed position;

a pivot rod secured to the bollard and received by a pivot carrier of the carrier device;

at least one protrusion extending outwardly from a first end of the carrier device;

a front retaining plate secured to the carrier device proximate the bollard on a side of the bollard opposing the recess;

wherein when the cover plate is in the opened position, the bollard is rotatable between the deployed configuration and the stowed configuration;

wherein when the cover plate is in the closed position, the cover plate is configured to be flush with the ground surface;

wherein the front retaining plate is configured to prevent rotation of the bollard beyond a deployed angle measured between the bollard and the carrier device in the deployed configuration;

wherein the at least one protrusion is adapted to contact an object with a torsional force when the object contacts the bollard in the deployed configuration with a predetermined force defined as a force that moves the protrusion relative to the ground surface;

wherein the bollard rotates between the deployed configuration and the stowed configuration about a longitudinal axis of the pivot rod; and wherein the front retaining plate is positioned and configured to retain the pivot rod within the recess when secured to the carrier device and allow removal of the pivot rod from the recess when unsecured from the carrier device.

11. The bollard system of claim 10 wherein the cover plate comprises a first cover plate and a second cover plate; wherein each of the first and second cover plates are hingedly connected to the carrier device and moveable between the open position and the closed position.

12. The bollard system of claim 10 wherein the lock plate is configured to prevent the bollard from moving from the deployed position when the bollard is impacted by a predetermined force from a first direction.

13. The bollard system of claim 10 wherein the carrier device has a first lock plate channel formed in a first wall on a first side of the recess and a second lock plate channel formed in a second wall on a second side, opposing the first side, of the recess; and wherein the first lock plate channel and the second lock plate channel are cooperatively configured to carry the lock plate when the bollard is in the deployed configuration.

14. The bollard system of claim 10 further comprising a tether having a first end secured to the carrier device and a second end secured to the lock plate.

15. The bollard system of claim 10 wherein the carrier device further comprises a plurality of planar members carried by the carrier device and adapted to support a combined weight of the bollard and an object placed upon the cover plate when in the stowed configuration; and wherein each of the plurality of planar members has an arcuate surface.

16. A bollard system comprising:

a bollard that is rotatable;

a carrier device having a recess adapted to carry the bollard;

a lock plate adapted to be received by the carrier device;

a cover plate carried by the carrier device and adapted to cover at least a portion of the recess of the carrier device;

a front retaining plate secured to the carrier device proximate the bollard on a side of the bollard opposing the recess;

a pivot rod secured to the bollard and received by a pivot carrier of the carrier device;

wherein the front retaining plate is configured to prevent rotation of the bollard beyond a deployed angle measured between the bollard and the carrier device;

wherein the carrier device has a first lock plate channel formed in a first wall on a first side of the recess and a second lock plate channel formed in a second wall on a second side, opposing the first side, of the recess; and wherein the first lock plate channel and the second lock plate channel are cooperatively configured to carry the lock plate.

17. The bollard system of claim 16 wherein the cover plate comprises a first cover plate and a second cover plate; wherein each of the first and second cover plates are hingedly connected to the carrier device.

18. The bollard system of claim 16 further comprising at least one protrusion extending outwardly from a first end of the carrier device.

19. The bollard system of claim 16 further comprising a tether having a first end secured to the carrier device and a second end secured to the lock plate.

20. The bollard system of claim 16 wherein the carrier device further comprises a plurality of planar members carried by the carrier device and adapted to support a combined weight of the bollard and an object placed upon the cover plate.

* * * * *